US006619828B2

(12) United States Patent
Montet et al.

(10) Patent No.: US 6,619,828 B2
(45) Date of Patent: Sep. 16, 2003

(54) HEADLIGHT WITH A VENTILATED MASK

(75) Inventors: Maurice Montet, Paris (FR); Jean Luc Meyrenaud, Livry Gargan (FR)

(73) Assignee: Valeo Vision (FR)

( * ) Notice: Subject to any disclaimer, the term of this patent is extended or adjusted under 35 U.S.C. 154(b) by 0 days.

(21) Appl. No.: 10/139,590

(22) Filed: May 2, 2002

(65) Prior Publication Data

US 2002/0191410 A1 Dec. 19, 2002

Related U.S. Application Data

(63) Continuation of application No. 09/513,560, filed on Feb. 25, 2000, now Pat. No. 6,435,704.

(30) Foreign Application Priority Data

Feb. 25, 1999 (FR) ..... 99 02344

(51) Int. Cl.[7] ..... F21V 11/00

(52) U.S. Cl. ..... 362/539; 362/351; 362/290; 313/117

(58) Field of Search ..... 362/279, 290, 362/321, 351, 354, 539, 509; 313/117

(56) References Cited

U.S. PATENT DOCUMENTS

| | | | | |
|---|---|---|---|---|
| 5,117,342 A | * | 5/1992 | Vlah | 362/217 |
| 5,938,317 A | * | 8/1999 | Thornton | 362/290 |
| 5,980,069 A | * | 11/1999 | Guerrero | 362/360 |
| 6,170,970 B1 | * | 1/2001 | Eto | 362/539 |

* cited by examiner

*Primary Examiner*—Sandra O'Shea
*Assistant Examiner*—Jacob Y. Choi
(74) *Attorney, Agent, or Firm*—Morgan & Finnegan, LLP

(57) ABSTRACT

A motor vehicle headlight comprises a light source, a reflector and an occulting mask. The mask comprises a set of elements which in pairs define, respectively, mutually facing faces which define between them passages extending through the mask in directions passing away from the light source.

25 Claims, 9 Drawing Sheets

HEADLIGHT WITH A VENTILATED MASK

This is a Continuation of application Ser. No. 09/513,560 filed on Feb. 25, 2000 now U.S. Pat. No. 6,435,704.

FIELD OF THE INVENTION

The present invention relates to motor vehicle headlights, and more particularly to headlights having a mask, generally in front of the lamp or light source of the headlight, for masking or occulting light received from the light source.

BACKGROUND OF THE INVENTION

An occulter, or mask, of this kind is well known for arresting some of the light radiation coming directly from the light source (the lamp), this light being directed firstly towards the cover glass of the headlight and secondly towards portions of the reflector which serve no optical purpose. One such mask is described in French patent specification No. FR 96 02387, which has a front face and upper, lower and side faces, which together cover the front part of the lamp of the headlight, and in which the side portions have ventilating windows.

These ventilating windows are formed by cutting out the sheet metal of which the mask is made, with reforming of the material outwardly in such a way that the latter projects out of the mask. Such apertures do not constitute passages that are wide enough to give the required amount of ventilation for the interior of the mask and the walls of the mask. In addition, such apertures allow some of the light rays from the lamp to pass through.

Simply to increase the number of these windows, or apertures, in order to improve the ventilation would allow more light to pass through the mask to reach the non-optical parts of the reflector, and this will be detrimental to the efficiency of the headlight.

DISCUSSION OF THE INVENTION

An object of the present invention is to propose a motor vehicle headlight in which the mask enables a large quantity of air to pass through it without being the source of optically undesirable leaks of light.

According to the invention, a motor vehicle headlight comprising a light source, a reflector and a mask, is characterised in that the mask comprises a set of elements which define in pairs, respectively, mutually facing faces such as to define between them passages through the mask, the said passages extending in directions which pass away from the light source.

Without in any way limiting the scope of the invention, the invention includes without limitation the following features, any one of which may, where practical, appropriate or desirable, be combined with any one or more of the others:

- at least some of the passages are oriented in such a way that a light ray from the light source arriving in the said passage is unable to pass through the passage without performing at least two reflections on the mutually facing faces;
- the said mask elements are thin elements which define, by each of their opposed sides, a face of an associated said passage;
- the said mask elements of the said set of elements are generally flat in form and extend substantially parallel to each other;

- the said passages lie in planes parallel to each other;
- the said mask elements extend substantially at right angles to an optical axis of the headlight;
- the said mask elements are in the form of annular rings, the axis of which is essentially parallel to the optical axis;
- each said annular ring defines a surface facing towards the light source and approaching the optical axis when the annular ring is traversed in a direction from the rear towards the front of the mask;
- the said annular rings consist of lamellae which face towards the light source, and each of which has a concave face facing towards the light source;
- the said mask elements lie in planes substantially parallel to the optical axis of the headlight;
- the adjacent edges of the said mask elements together define a geometric form;
- the said adjacent edges are the edges which are closest to the light source;
- the said adjacent edges are the edges furthest away from the source;
- the said adjacent edges are anterior edges of the elements;
- the mask includes a base wall, and in that the said elements have a root portion joined to the said wall;
- the mask has an internal wall which is reflective to light, but only within a selected colour range, when the lamp is extinguished;
- the mask has two fastening branches adapted to pass through the reflector, and a wire spring adapted to cooperate with two support elements, each of which is disposed at the end of a said branch of the mask, the wire spring being adapted to come into engagement on a rear face of the base of a lamp which is positioned in the base of the reflector;
- the mask consists of a first member, having a lug for fastening to the rear of the headlight, and having an external diameter which is smaller than the diameter of a base opening of the reflector, and a second member having a diameter greater than the diameter of the base opening in the reflector, and in that the mask includes means for fastening the second member on the first member;
- the mask consists of two members and a spring between the said two members, the spring urging the two said members away from each other, the two said members being provided with respective elements adapted to cooperate with each other so as to hold the said members fixed to each other while compressing the spring between them;
- the said spring has the general form of an annular ring defining corrugations transverse to the mean plane of the annular ring;
- the mask is made by a process including a step of hydroforming followed by a step of cutting;
- the set of mask elements defining mutually facing faces consists of a set of annular rings stacked on a support structure.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
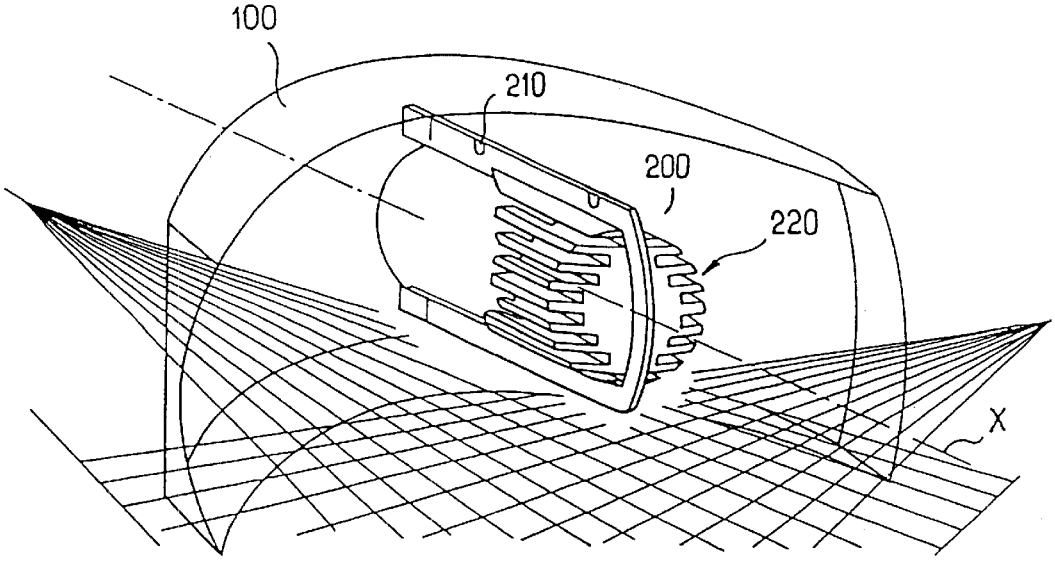
FIG. 1 is a perspective view of a headlight in accordance with the invention.

FIGS. 1 to 6 show an occulting mask 200, or occulter, in accordance with the invention, mounted in the base of a reflector 100. The mask 200 consists of two main parts, which will be called the first and second main parts.

The first main part is in the form of a U-shaped arch 210, the ends of the branches of which are inserted in the base of the reflector 100, with the base of the U extending transversely in front of a lamp 150 of the headlight. The arch 210 lies in a vertical plane passing through the longitudinal main axis X of the lamp 150.

This first main part of the mask 200 also includes a cylindrical shell piece 260 which is closed by a base wall and which is disposed between the branches of the arch 210, in such a way that the branches of the arch extend along the side walls of the cylinder of the shell piece 260, parallel to the main axis of the cylinder.

The shell piece is, in addition, so positioned in the base of the arch 210 that its base wall is aligned on one of its diameters by the base of the U shape defined by the arch 210. The shell piece 260 has a diameter, transverse to the arch, which is equal to the spacing between the two branches of the arch.

The second main part of the mask 200 consists of a set of lamellae or fins 220, each of which is substantially rectangular, these fins being aligned in the direction X. The fins 220 are parallel to each other, and lie in horizontal planes which are separated each time by a gap of the same width as the thickness of one fin 220. The fins are in addition offset with respect to each other horizontally, so that in transverse cross section taken on the axis X, the centres of the fins lie on a mean circle centred on the lamp 150. They thus constitute a cylindrical wall of revolution, having the axis X and surrounding a front portion of the lamp 150.

The fins 220 have a common width at right angles to the axis X, so that a surface passing through their inner longitudinal edge defines a cylinder of revolution about the lamp, and the same is true for a surface passing through their longitudinal outer edge.

The cylindrical shell piece 260 is placed inside this cylindrical wall defined by the fins, in a front portion of the said cylindrical wall, so as to constitute its base and so as to bound the side walls in the front portion. In this front portion, the fins therefore extend along the outer side surface of the shell piece 260, on which surface they are joined by their internal longitudinal edges.

Figure 3:
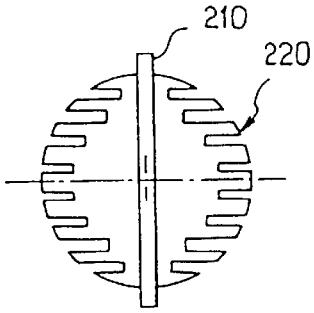
FIG. 3 is a front view of a mask of the headlight of FIGS. 1 and 2.
Figure 4:
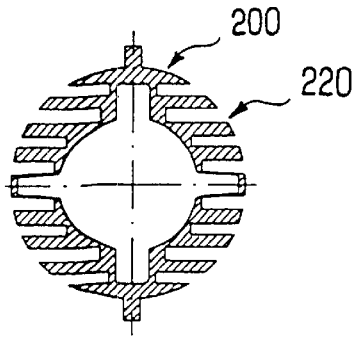
FIG. 4 is a view of the same mask as in FIGS. 1 to 3, seen in transverse cross section on the section plane indicated at AA in FIG. 2.

FIG. 3 shows that the base wall of the shell piece 260 is in the form of a disc, the radius of which is smaller than the radius of the mean cylindrical wall defined by the fins 220. The fins extend towards the rear in extension of the rear edge of the shell piece 260. The set of fins, as a whole, therefore defines a cylinder surrounding a front portion of the lamp, which is located inside a front portion of the mask which includes the cylindrical shell piece 260, and which is left free within a rear portion.

The fins 220 extend beyond the rear edge of the shell piece 260, over a length which varies according to the height within the mask. This extension length has, for the fins nearest to the branches of the arch, a value which is greater than the length of the shell piece 260.

The heat which is transmitted by radiation to the shell piece 260 is propagated by conductivity within the fins 220 fixed to it, which constitute cooling fins, increasing the heat exchange surfaces of the mask with the air which is present within the headlight.

The fins 220 described here do not only have this function of increasing the heat exchange surface of the mask. In particular, in their part that lies in the rear of the shell piece 260, they have a geometrical arrangement which is such that the set of fins itself constitutes an optical barrier which is sufficiently effective not to have to be doubled up by a continuous wall such as the shell piece 260.

Figure 2:
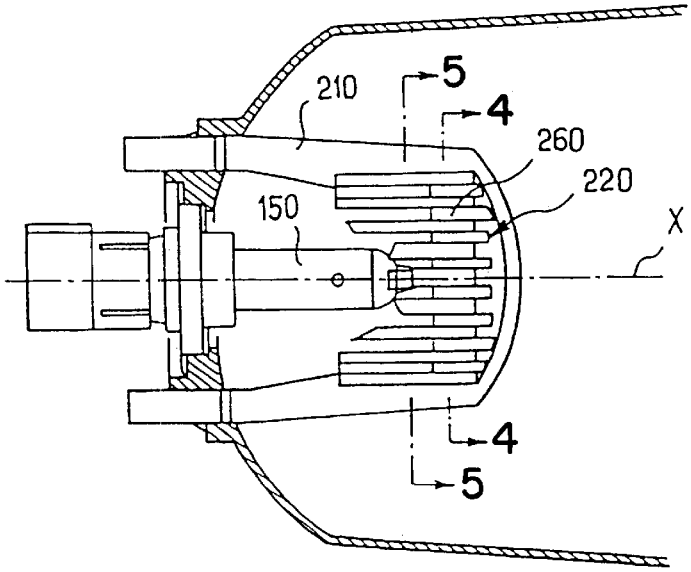
FIG. 2 is a side view of a base portion of the headlight of FIG. 1.
Figure 5:
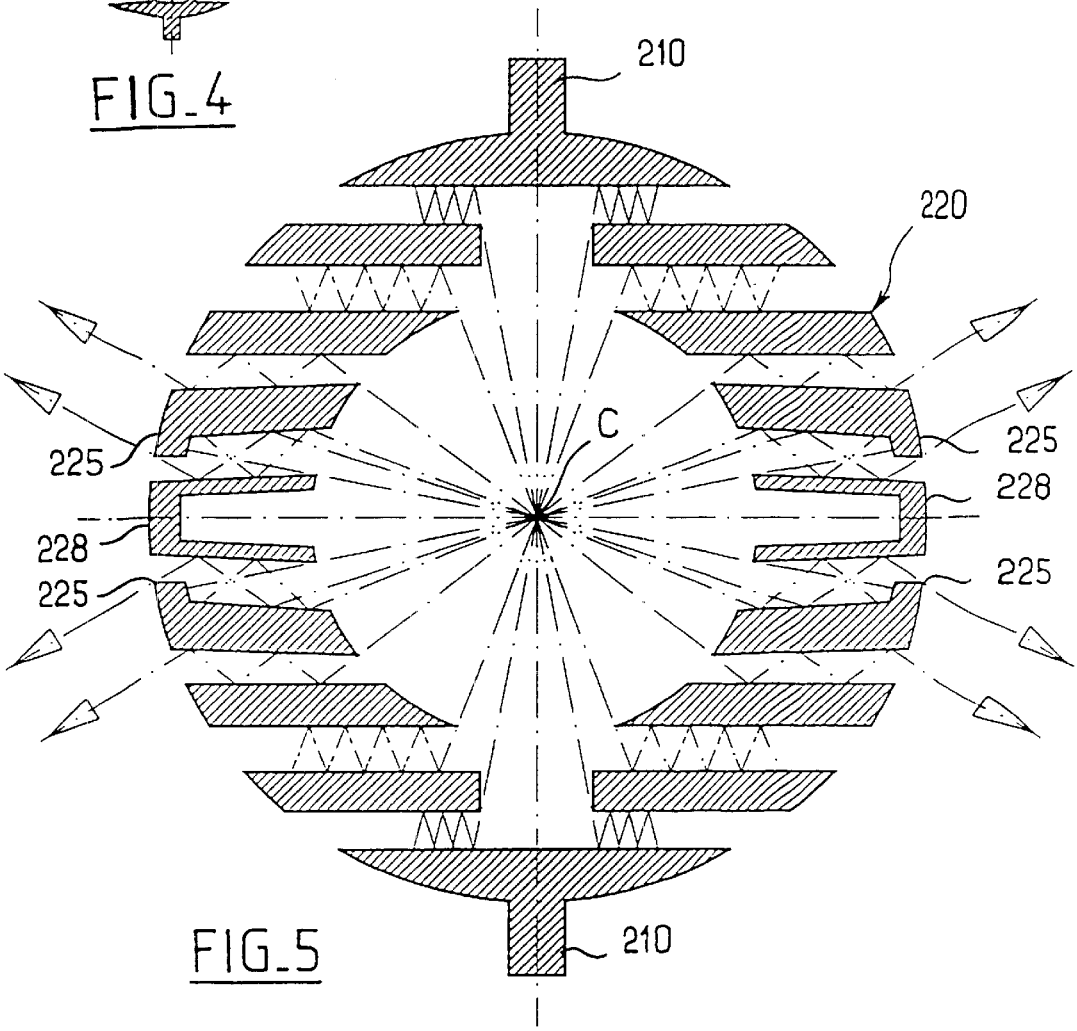
FIG. 5 is a view of the mask of FIGS. 1 to 4, seen in transverse cross section taken on a section plane indicated at BB in FIG. 2.

FIG. 5 is a transverse cross section of the same mask as that shown in FIG. 2, the cross section being taken on the vertical plane B—B which is located far enough towards the rear that it does not intersect the side walls of the shell piece 260. FIG. 5 shows at a point C the location of the filament of the incandescent lamp 150.

In FIG. 5, the path of the rays emitted by the filament C, and arriving in the gaps between the fins 220, is shown in FIG. 5. Here, the fins are thin with parallel faces. The gaps between the fins lie in planes which are bounded by fin surfaces which are mutually facing, that is to say they are in parallel facing relationship with each other. These faces bounding the gaps extend in practice, each time, in a direction which is oblique to the direction of an incident ray from the point C, arriving in the gap concerned. Such a ray therefore penetrates into the aperture of the gap which is open within the mask, and it has to impinge on the flank of the gap which faces towards the centre C.

In a preferred arrangement of the invention, the gaps extend over a distance which is sufficiently long, extending away from the lamp, so that after reflection on the first flank, the light ray will have to impinge on the second flank of the gap. Thus, the gaps have an orientation, a thickness and a length which are such that no ray emitted by the filament can traverse a gap without being reflected at least twice on the flanks of that gap. After these two reflections, the intensity of the light wave is somewhat diminished. The light passing through the mask via the gaps therefore has an intensity which is weakened, in particular by its passage within the gaps. This weakening is such that the wall within interstices defined by the fins may be considered from the optical point of view as a flat wall.

From the thermal point of view, a gap between two fins 220 provides each time an aperture extending through the envelope defined by the mask, enabling air to circulate between the inside and the outside of the mask.

In the mask 220 of the invention, therefore, a very large proportion of the envelope of the mask is open; but at the same time, only an intensity of light which is weak enough not to be a nuisance can escape across it.

In the embodiment shown in FIG. 5, it will be noted that the fins 228 situated at mid height of the mask, and the fins which are directly adjacent to these central fins 228 extend in directions which are substantially radial. The fins directly adjacent to a central fin 228 are extended at the level of the their outer edge by a flange 225 which projects towards the central fin 228. Such a flange 225 will stop any light ray that may penetrate into the gap in a direction close to the principal direction of the latter.

Thus, in the case of a gap which extends in a direction close to the radial direction, the internal surface area of the gap that faces towards the centre C is increased by the provision of such a flange on the flank that faces towards the centre C. The flange 225 is oriented in such a way that it is substantially at right angles to a said ray arriving on it from the lamp, so that it completely blocks this ray.

In an advantageous arrangement, a fin may define a cavity which is open towards the interior of the mask, as shown in FIG. 5 in the case of the central fins 228. In this way the internal volume of the mask is increased, as is its ability to be correctly ventilated.

In a preferred arrangement according to the invention, the surfaces, in particular the surfaces of the fins, may be finely textured by moulding, or roughened after moulding, so as to enhance the anti-reflection properties of the component against parasitic rays.

In this case the apertures are of an elongate form, which is particularly well adapted to enable a flow of air to pass through them. In the case described here, the flanks of the apertures are flat and parallel to each other. However the invention is not limited to such geometries. More generally, the invention provides that an aperture (or gap between lamellae) extends substantially obliquely with respect to a radial direction, and the interstices or passages that extend through the optical envelope may take a number of different forms.

Figure 8:
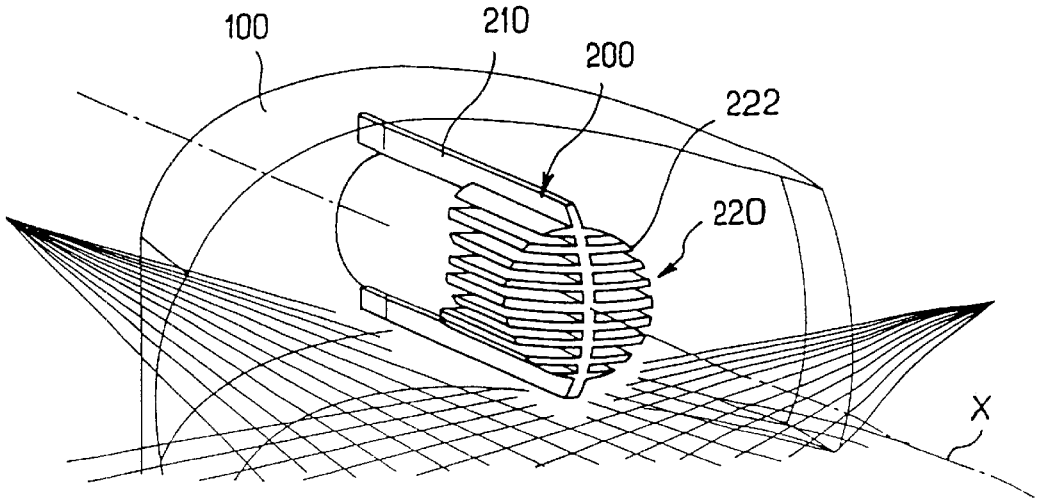
FIG. 8 is a perspective view of a headlight in a third embodiment of the invention.

Reference is now made to FIG. 8, showing another embodiment of the invention in which the cylindrical wall defined by the fins 220 may be not doubled up by a continuous internal envelope at any location. In this version, the fins are for example fixed to the arch 210, with the upper and lower endmost fins being fixed along the whole of their longitudinal edges, while the fins located between these endmost fins are not fixed to the arch 210 except at their front ends.

In this arrangement, the fins 220 extend from the point at which they are fastened on the arch, firstly at right angles to the arch 210, spaced away from the principal plane of the latter, and then towards the rear of the headlight, defining a cylindrical wall which is closed at its front end around a front portion of the lamp.

In the embodiment shown in FIG. 8, the mask has a set of fins which constitute a wall 222 placed transversely in front of the lamp. This wall, which has the same constitution as the side walls defined by fins described earlier herein, works optically in the same way as those side walls. They have a geometry which enables a light ray to pass through an interstice or gap only after at least one reflection within the gap, and preferably two.

Figure 6:
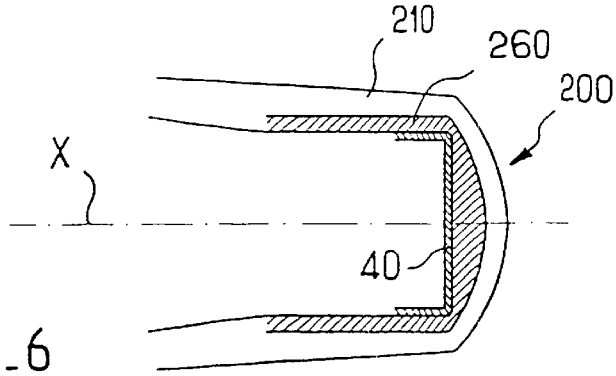
FIG. 6 is a view in longitudinal cross section of the mask of FIGS. 1 to 5.

In one particular version of the invention, a coloured reflective element 40 is disposed within the base of the mask as shown in the longitudinal cross section in FIG. 6. Such a coloured reflective element 40 reflects the rays that are incident on it, while communicating its colour to them. A reflective element placed in this way is particularly effective for giving the reflector of the headlight a coloured appearance when the light is extinguished. The colour of the reflective element 40 is thus communicated to a zone of the reflector which is limited to one portion that has no detrimental optical effect, and which is sufficiently extensive for the reflector to have the particular colour of the reflective element.

In the case of a reflector which has a complex faceted surface, an effect of a multiplicity of diffuse reflections is obtained with the colour of the reflective element, when the lamp is extinguished. When the lamp is lit, the colour of the reflective element is not picked up on the lighting beam, and the optical assembly therefore remains compliant with the regulations in force.

An arrangement with horizontal lamellae has been proposed here. However, the invention also provides that the lamellae can be arranged in a concentric distribution with respect to the lamp, or again in a vertical disposition, and more generally in any form that is adapted to enable the lamellae to be stripped satisfactorily from the mould, whether they are parallel or oblique with respect to each other.

The masks described above also constitute embellishers. In this connection, their particular form includes a front face which can be polished so as to obtain a brilliant appearance, or they can be given a particular type of coating to achieve a particular aesthetic result.

The mask described here is made as a single moulded component, of metallic material so as to provide high conductivity in the fins, which thereby constitute a particularly effective heat exchanger. With such a mask obtained by moulding, the optical profile, that is to say the geometry of the mask defining the masked zones of the reflector, is here obtained directly by moulding. However, the mask described here is a component which can also be partially cut out or perforated.

All in all, the mask described here is particularly simple to make, in that it consists of a single component, or two in the case of a mask which includes an internal coloured capsule or reflective element. Such a mask is made without any seaming or reforming operation being necessary. Because of the particularly effective ventilation provided by the invention, it is no longer necessary to put the source of heat constituted by the lamp as far away as possible.

It is no longer necessary to deposit an anti-reflection layer inside the mask. Deposition of such a layer can nevertheless be provided of course, but it is not necessary to ensure that this coating is resistant to temperatures as high as those to which conventional anti-reflective layers are subjected.

Figure 9:
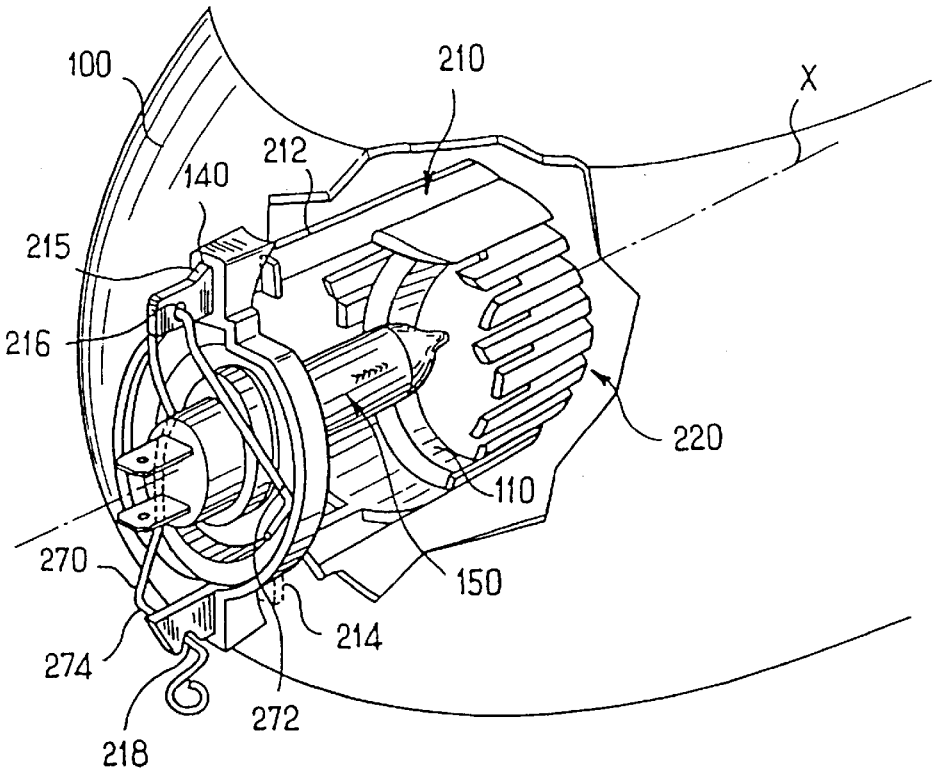
FIG. 9 is a perspective view from the rear, partly cut away, showing the mask of FIGS. 1 to 6.

A preferred method of fixing the mask described above with reference to FIGS. 1 to 5 will now be described with reference more precisely to FIG. 9.

The mask 200 has two fastening branches 212 and 214 which extend towards the rear and through the reflector 100. In an end zone of the upper branch 212, there are formed two shoulders 213 (FIG. 10) which project laterally on the branch. These two shoulders 213 bear against the edges of a passage 110 extending through the reflector 100, when the upper branch 212 is introduced into the passage 110.

Figure 10:
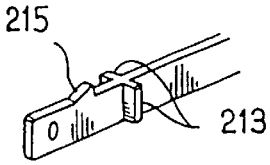
FIG. 10 is a scrap view in perspective showing the detail of the end of one fastening branch of the mask of FIG. 9.

Between the end of the upper branch 212 and the shoulders 213, there is a nib 215, FIG. 10, which projects in the common plane of the two branches 212 and 214. The end of the lower branch 214 also has a similar nib, disposed in symmetrical relationship to the nib 215 of the upper branch, with reference to the central axis X.

The vertical dimension of the passages 110 is sufficiently large to enable a branch and its nib being compressed by virtue of the elasticity of the branch, when the mask is pushed back towards the rear.

The upper branch 212 has near its end an oblong through hole 216. As to the lower branch 214, this has in its end portion a notch 218 on its side facing away from the axis X. The hole 216 and the notch 218 together constitute a fastening for a wire spring 270 for retaining the lamp 150. This spring 270 is in the form of a U-shaped clip, the base of which extends through the hole 216 with its two arms in engagement against the rear of the lamp 150. One of the arms 274 is extended beyond this engagement, to be seated in the notch 218. The wire clip 270 thus constitutes a hinge within the hole 216 of the branch 212. Its other arm is straight and extends over a distance joining the hole 216 to a point of engagement on the base of the lamp at mid height of the latter.

The arm 274 is bent back at its end at right angles to the branches of the mask.

The notch formed in the end of the branch 214 constitutes an oblique sliding ramp for the bent-back portion of the arm 274 of the wire fastening clip 270. By pressing the wire clip 270 against the base of the lamp, this curved end portion of the arm 274 slides on the oblique ramp until it passes over the summit of that ramp and becomes locked in the notch 218.

Figure 11:
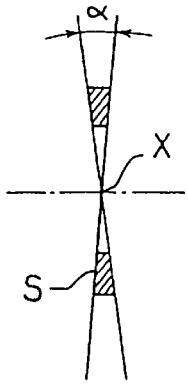
FIG. 11 is a view in transverse cross section of the branches of the mask of FIGS. 9 and 10.
Figure 12:
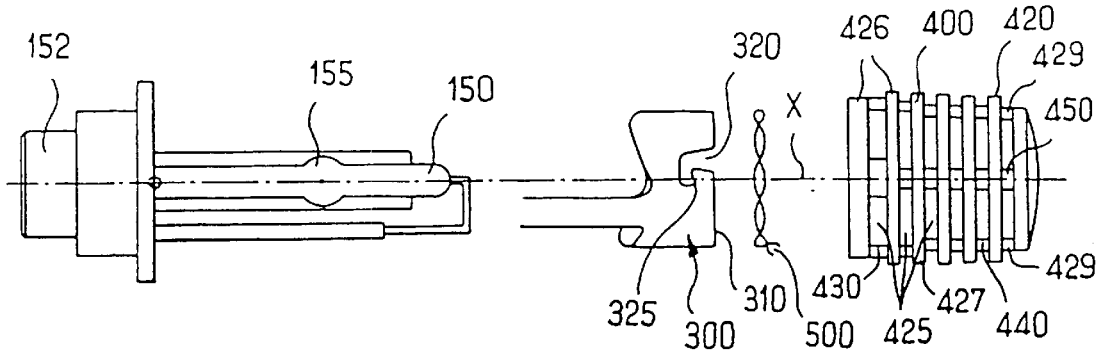
FIG. 12 is an exploded side view of a mask in a fourth embodiment of the invention.
Figure 13:
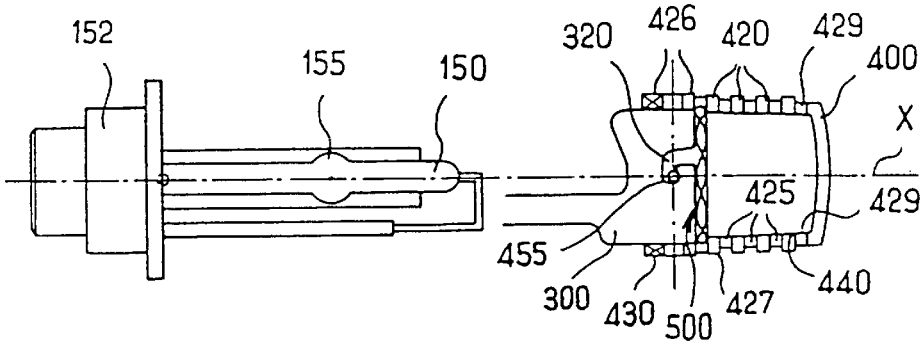
FIG. 13 is a partially exploded side view of the mask of FIG. 12.
Figure 14:
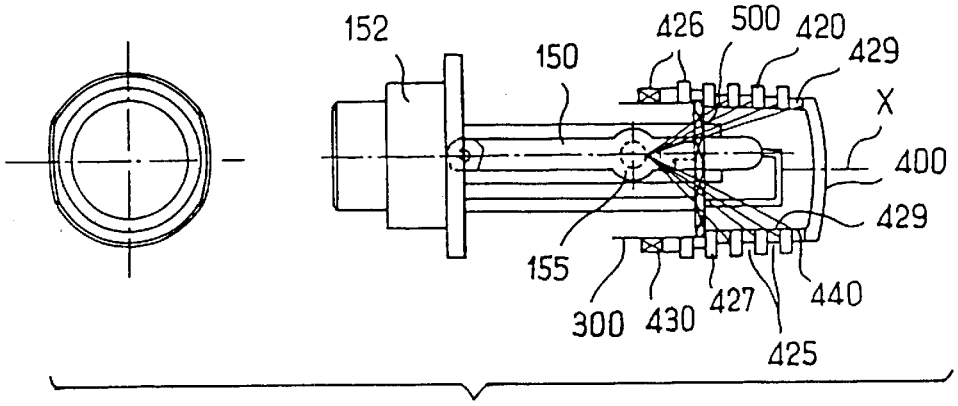
FIG. 14 is a side view of the mask of FIGS. 12 and 13.
Figure 15:
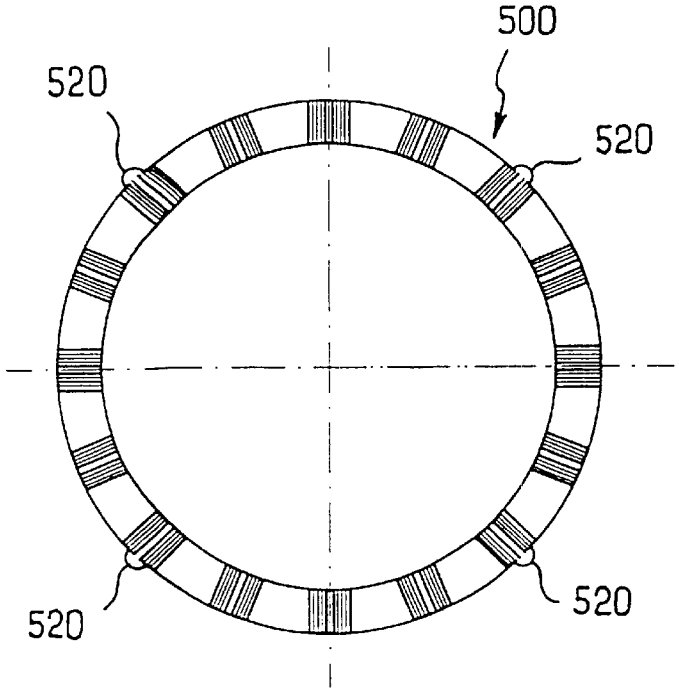
FIG. 15 is a front view of the spring in the embodiment shown in FIGS. 12 to 14.
Figure 16:
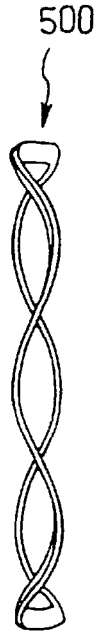
FIG. 16 is a side view of the spring of FIG. 15.
Figure 17:
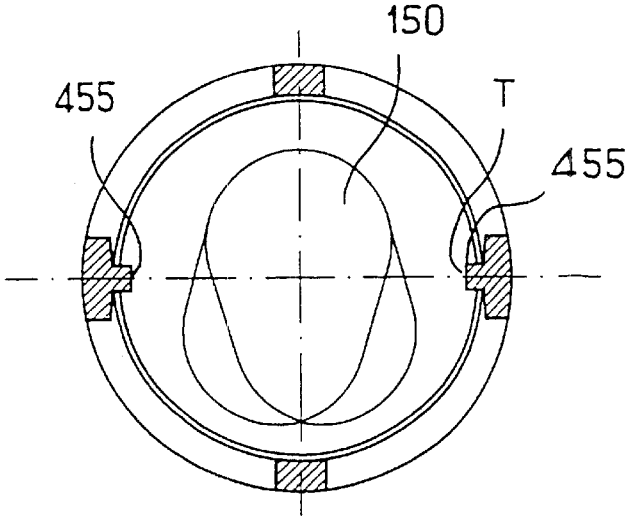
FIG. 17 is a view in transverse cross section of the mask of FIGS. 12 to 16, shown assembled.

Preferably, the two fastening arms 212 and 214 of the mask 200 have a transverse cross section which is trapezoidal in form, becoming thinner towards the central axis X, so that the sides of the transverse cross section together define an angle $\alpha$ centred on the axis X as shown in FIG. 11. These sides are thus aligned on the centre of the lamp, so the branches have a stop surface "S" for arresting light rays and facing towards the lamp, which is as small as possible.

The branch 212 and the branch 214 of the mask both have, as described above, a pair of shoulders 213, while the reflector 100 has corresponding cavities for receiving these shoulders 213. The upper and lower shoulders 213 are of different forms, and the upper and lower receiving cavities are also different from each other, so that it is not possible to mount the mask 200 by accidentally reversing the positions of the two branches within the reflector 100.

Because the masks, like the reflectors, have forms of shoulders and corresponding cavities which are specific to the side in which they are intended to be mounted, it is impossible to mount a mask intended for a given side on a reflector intended for the opposite side.

It will be noted that the fastening arms 212 and 214 pass through the reflector 100, and project from the rear of the latter, thereby constituting thermal conduction paths between the mask and the rear of the headlight.

Figure 7:
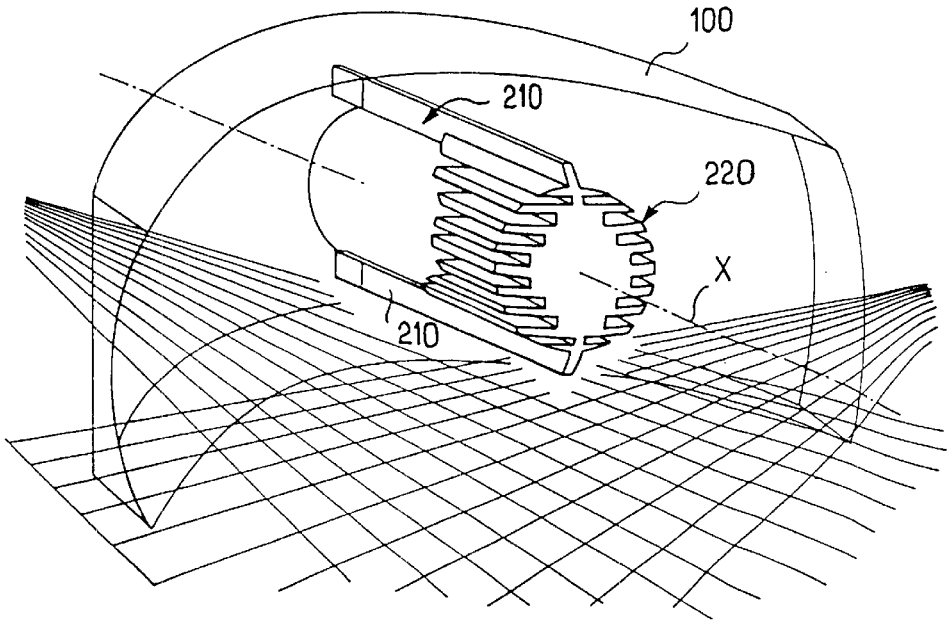
FIG. 7 is a perspective view of a headlight in a second embodiment of the invention.

Other embodiments can be adopted besides those already described above. Thus, with reference for example to FIG. 7, the arch 210 may be omitted and replaced by two bars, with the front surface of the mask then having no forwardly projecting element.

Again, and with reference now to FIGS. 12 to 17, in another version of mask in accordance with the invention, shown in these FIGS. the mask is in two parts, namely a skirt 300 and a cap 400, each of which constitute a masking barrier around the lamp 150. The skirt 300 is inscribed on a cylindrical surface of revolution the axis of which coincides with the axis X of the lamp 150, and which defines the skirt about a front end portion of the lamp. This skirt 300 is provided with a lug 152 for fastening to the rear of the reflector.

This skirt 300 is open at the front to define a cylindrical wall having a front edge 310 which is substantially circular and which is contained within a plane at right angles to the longitudinal axis X of the lamp 150. Two notches 320, located in opposed relationship to each other, are open in this circular edge 310. These notches 320 constitute a substantially straight first position which extends at right angles to the plane of the edge 310. This first position is extended by a second portion at right angles to the direction X, which has a front edge adjacent to the edge 310. The front edge is rounded towards the front on the skirt 300, thereby constituting a reinforcement for the forwardly facing notch in the skirt.

This rear portion 300, or cylindrical wall, is open at the front to define a front edge 310 which is substantially circular and which is contained within a plane at right angles to the longitudinal axis X of the lamp 150. Two notches 320, located in opposed relationship to each other, are open in this circular edge 310. These notches 320 constitute a substantially straight first portion which extends at right angles to the plane of the edge 310. This first portion is extended by a second portion at right angles to the direction X, which has a front edge adjacent to the edge 310. The front edge is rounded towards the front of the skirt 300, thereby constituting a reinforcement for the forwardly facing notch in the skirt.

The skirt has an outer diameter 325 which is smaller than the diameter of the hole in the base of the reflector. Thus the skirt 300 is positioned through the rear of the headlight, through this hole.

The mask assembly in FIGS. 12 to 17 shows the cap 400 in the general from of a cylinder of revolution, closed at the front by a base wall. The said walls of this cap 400 are constituted by a set of annular elements, 420, 526, 427 which are inscribed in the cylindrical wall and centered on the axis X. Each of them is therefore disposed within a plane at right angles to the direction X.

The annular elements 420, 426, 427 are spaced from each other along the axis X by gaps 425 which have substantially the same thickness as the annular elements 420. In the same way as in FIG. 5, the annular elements 420 bound the gaps by defining faces in facing relationship with each other such that each gap 425 is in one plane.

The annular elements 420 are spaced from each other along the axis X by gaps 425 which have substantially the same thickness as the annular elements 420. In the same way as in FIG. 5, the annular elements 420 bound the gaps by defining faces in facing relationship with each other such that each gap 425 is in one plane.

The vertical plane of the gaps do not pass through a zone of light emission. In the present case, the lamp 150 is a discharge lamp, the main emission zone of which is situated halfway along the lamp, forming a bulge 155 on the lamp. The light rays coming from the bulge 155 and arriving in a gap 425 are too oblique, with respect to any direction in which the gap extends, to be able to pass without reflection through the gap 425 concerned.

These rays therefore reach one flank of the gap 425 which faces towards the bulge 155, at an angle of incidence such that the rays, after being reflected, are again sufficiently oblique with respect to the plane of the gap to be directed towards the opposite flank of the gap, and not directed to the outside of the mask.

The annular elements 420, 426, 427 are fixed on four mounting members 429, 430, 440 parallel to the axis X. These mounting members 429 also carry at their front end a solid wall transverse to the axis X, which is bowed slightly forward.

The cap 400 defines a substantially cylindrical internal cavity 450, the inner diameter of which, at the level of the open rear end of the cap, is equal to the outer diameter of the skirt 300.

The cap 400 is thus arranged to receive the front edge of the skirt 300 in this open rear end. Going from the rear toward the front in the interior of the cap 400, it internal diameter reduces sharply, due to the fact that an annular ring 427 extends more deeply inwards than the annular elements situated between it and the rear opening.

The cap 400 therefore constitute a cylindrical rear receiving wall of the skirt 300, bounded at the front by an inwardly projecting annular element.

The arrangement of FIGS. 12 to 17 also includes a spring 500 which is arranged to be sandwiched between the front edge 310 and the annular ring 427.

The spring 500 consists of a leaf turned back on itself and having the general form of an annular ring, the leaf being, at all points on the said ring, transverse to the axis of revolution of the ring. Along this annular ring, the leaf defines corrugations transverse to the mean plane of the annular ring. In the present case, the leaf defines, along the annular ring, five complete corrugations, that is to say five corrugations each of which consists of an upward curve followed by a downward curve. The diameter of the said annular ring is equal to the diameter of the edge 310 of the skirt 300.

The fact that the annular ring consists of a leaf gives it a width of engagement on the edge 310, transverse to the line defined by that edge, which prevents the annular ring from sliding on the edge within the skirt 300. However, in another version of the invention, the annular ring may consist of a wire element.

When it is sandwiched in this way between the front edge 310 and the annular ring 427, the corrugations of the annular ring are slightly flattened, and, by elastic reaction of its corrugations, it exerts a thrust on the skirt 300 and the cap 400 to move them apart.

The cap 400 has two fingers 455 which project on its internal surface and which extend towards the interior of the cap. The two fingers 455 are diametrically opposed within the cap 400, and they are near enough to the rear opening of the cap to be able to be put into corresponding relationship in front of the notches 320 in the skirt 300, and be introduced into these notches 320 by bringing the skirt 300 and the cap 400 together against the elastic reaction of the annular ring 500.

The cap 400 is therefore easily positioned on the skirt 300 through the front of the headlight, after the skirt 300 has been mounted within the base of the latter.

It is sufficient to fit the fingers 455 within the notches 320 of the skirt, to press the cap 400 against the skirt 300, and then to pivot the cap 400, in order that the fingers 455 will come into engagement against the front transverse edge of each notch 320.

The elastic thrust exerted by the spring 500 on the cap 400 and the skirt 300 is thus balanced right around the axis X, so that the cap 400 will position itself coaxially with the skirt 300. In the definitive position of the cap 400, the skirt 300 projects behind the latter, and defines, by its rear notch, the optical profile of the mask assembly, corresponding to the geometry of the reflector.

The spring 500 preferably has external radial lugs 520 which are introduced, by virtue of the elasticity of the spring, between the annular ring 427 and an annular ring which is directly behind the annular ring 427, preventing escape of the spring 500 out of the cap 400 during the assembly operation. Because of such an arrangement, it is easy to fit from the front of the headlight an embellisher which is too large to pass through the rear aperture of the reflector 100.

In another version, the spring 500 may be replaced by flexible portions defined by the edge 310 of the skirt 300.

An arrangement of the above kind is of particular advantage in the case of arc lamps, the base of which has a small seating diameter, so that the rear aperture for fitting the arc lamp within the reflector has a small diameter, whereas an arc lamp is rather large in front of its base. For arc lamps it is therefore necessary to use masks or embellishers of large diameter which cannot pass through the rear aperture of the reflector.

Figure 18:
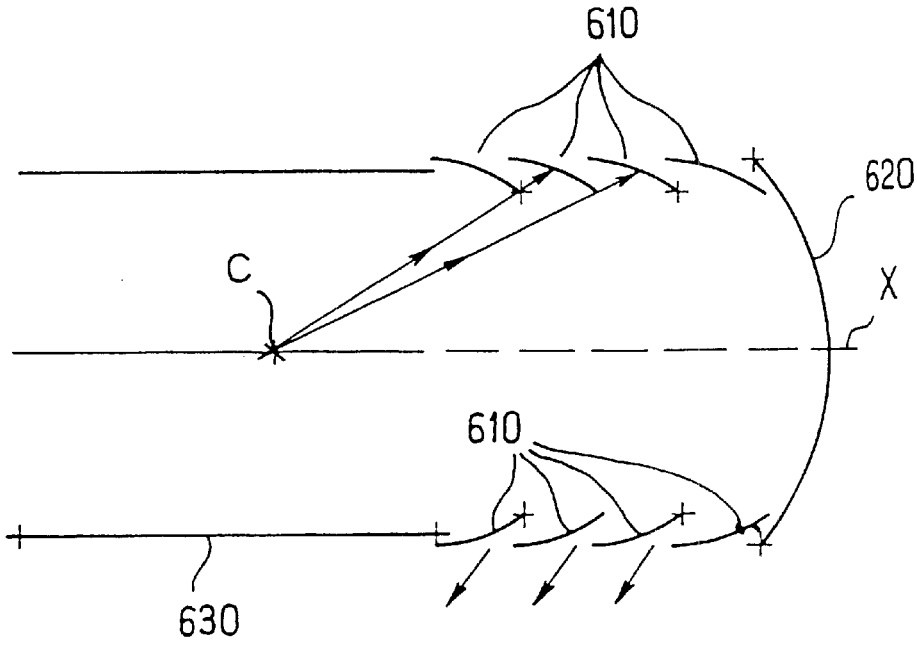
FIG. 18 is a view in longitudinal cross section of a mask in a fifth embodiment of the invention.
Figure 19:
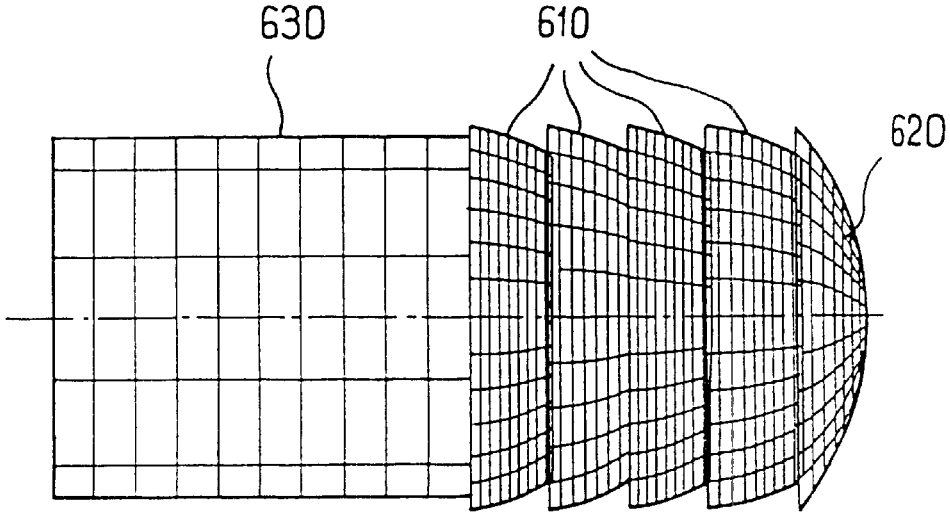
FIG. 19 is a side view of the same mask.

Reference is now made to FIGS. 18 and 19 showing a fifth embodiment of the invention. In FIG. 18, the lamellae or fins are in the form of annular rings which extend at right angles to the optical axis X of the mask. More precisely, these fins, in transverse cross section, are in the form of thin lamellae which have an elongated transverse cross section defining a path which is oblique with respect to the main direction X, so as to approach the lamp when the fins are traversed from the rear of the mask to the front.

Thus, for each of the fins indicated at 610 in FIGS. 18 and 19, these fins surround the light source and are spaced from the main axis X divergently towards the rear of the mask.

The fins are spaced from the central axis of the lamp in a slightly curved form, having a concavity facing towards the light source. Each of the fins 610 therefore has the form of a portion of a hemisphere defined between the diameter of a sphere and a level of the sphere between that diameter and a pole of the sphere. Since in the present case the light source C lies slightly behind the set of fins 610, the light rays emitted from the source C arrive on the fins transversely to the latter, and substantially at right angles to the fins.

In addition, the fins are disposed along the main axis X of the light source in accordance with a fixed increment, which in this example is so chosen that a rear end of each fin is located at the same level as the front end of the fin directly behind it. Thus, the light from the source C is unable to pass between the fins without impinging on one of them. The fins 610 are accordingly arranged, with respect to the light source C, in the same way that tiles are arranged on a roof in relation to the main direction of rainfall. However, by contrast with an arrangement of tiles, the fins are separated from each other in such a way that there is a gap between the fins 610 which permits effective ventilation of the interior of the mask.

The mask of FIGS. 18 and 19 is covered at its front end by a cap 620 which is in the form of part of a sphere.

In this version, the set of fins 610 constitutes a front portion of the mask, the rear portion of which is provided by a continuous cylindrical skirt 630. However, the mask can, in a modification, consist entirely of the fins.

Figure 20:
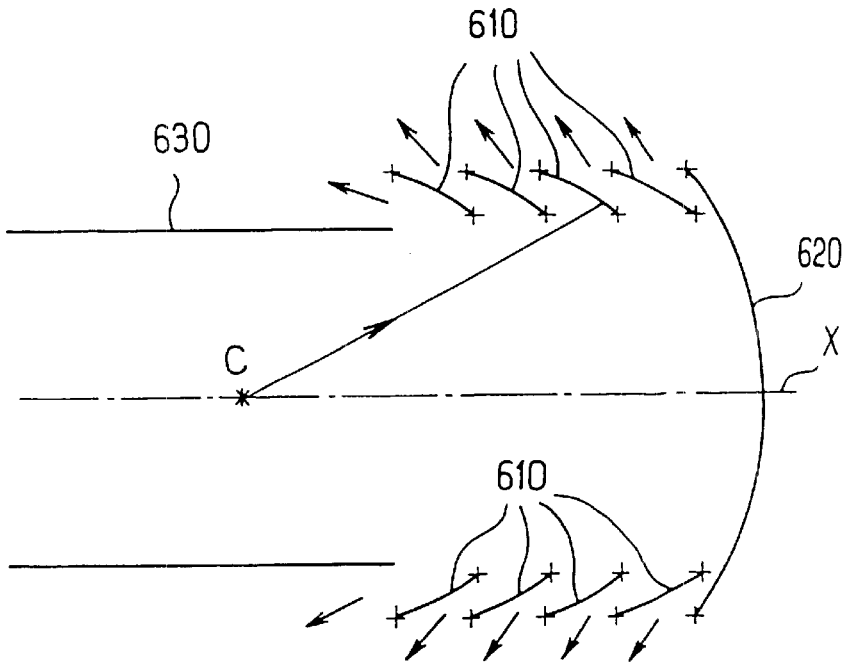
FIG. 20 is a view in longitudinal cross section of a mask in a sixth embodiment of the invention.
Figure 21:
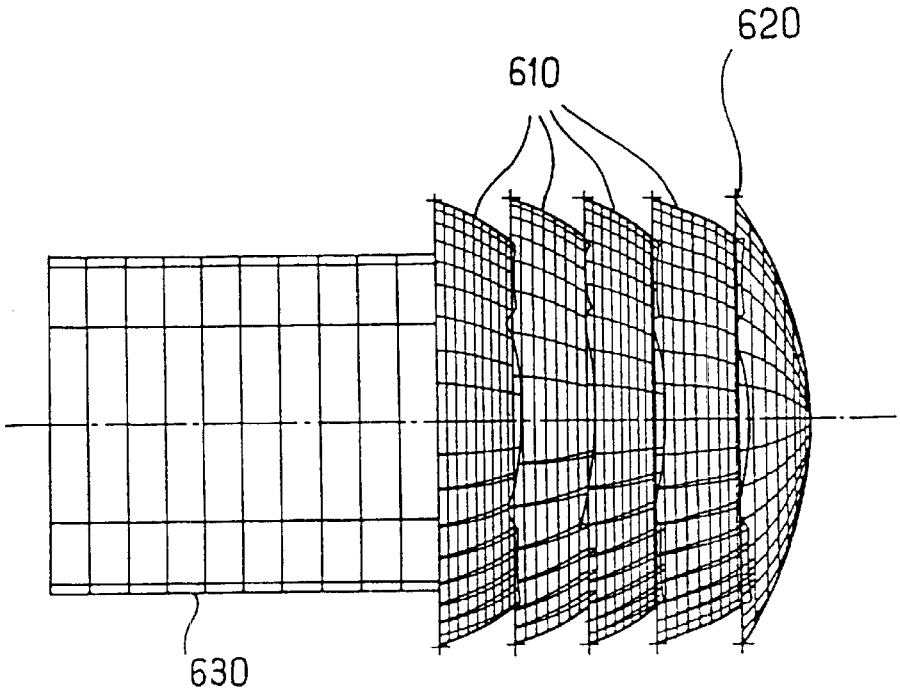
FIG. 21 is a side view of the same mask.
Figure 22:
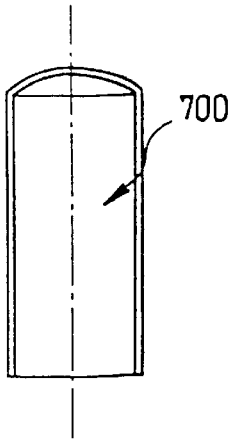
FIGS. 22 to 24 show respectively, in longitudinal cross section, a mask in accordance with the invention in three successive steps in its manufacture.
Figure 23:
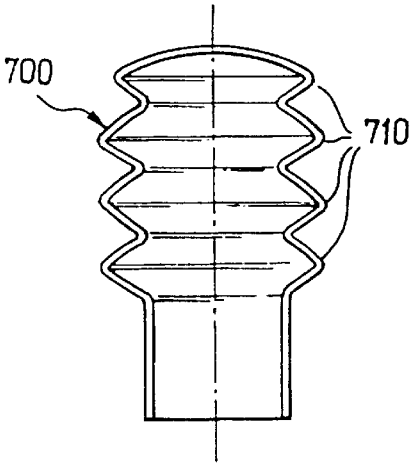
Figure 24:
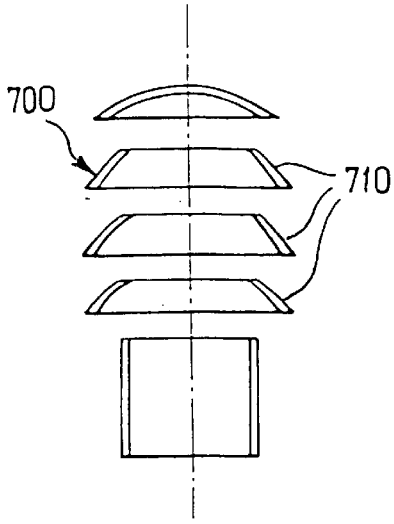
Figure 25:
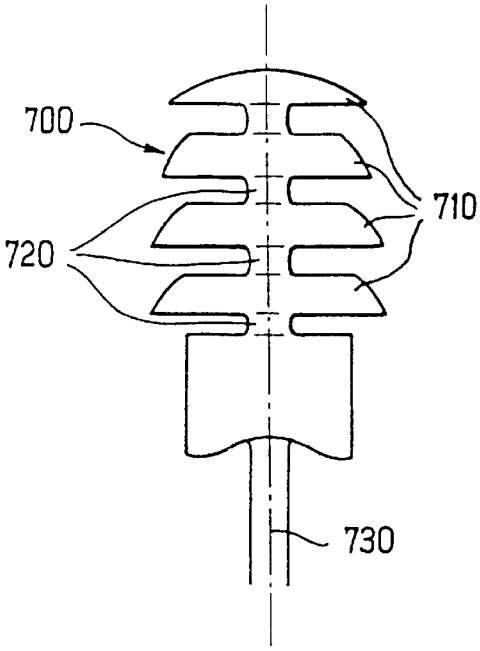
FIG. 25 shows the mask corresponding to FIGS. 22 to 24, in its final state.

Reference is now made to FIGS. 20 and 21 showing a sixth embodiment of mask according to the invention. In the version seen in FIG. 20, the mask differs from that shown in FIGS. 18 and 19 in that each of the fins 610 extends in a direction which is oblique to the optical axis X, which is more open to the outside than in the previous embodiment. In other words, the lamellae or fins 610, in the form of annular ring elements, make, in longitudinal cross section, an angle with the axis X which is greater than in the previous case.

The general angle of the fins with respect to the axis X is about 20° in the case shown in FIGS. 18 and 19, whereas in FIGS. 20 and 21 it is about 45°. Thus, the gap between the fins 610 is wider. However, in this example, it can also be seen that light rays coming from the light source C are unable to pass through the set of fins without impinging on one of them. In this example, the light rays impinge substantially at right angles on the fins 610, so that the attenuation of the light flux is particularly effective, while the interior of the mask is satisfactorily ventilated. In the embodiment of FIG. 21, the rear skirt 630 of the mask is of substantially smaller diameter than the front portion of the mask consisting of the set of fins 610.

Masks according to the invention may, in a further modification, be made by stacking annular members, to form the fins, on a skeleton which preferably includes the terminal member such as the fin 620 in FIGS. 18 to 21; two parallel arms are then fixed on this terminal member. Such an arrangement enables very high precision to be obtained in the geometry of the fins and that of the terminal member.

Reference is now made to FIGS. 22 to 25, showing a further embodiment in which the mask is made from a workpiece in the form of a cylindrical sleeve 700 which is formed in one piece from sheet metal. The sleeve 700 is put into a mould with annular cavities, and a liquid is injected into the sleeve under pressure. The sleeve 700 is thereby deformed with outward annular swellings 710 like the corrugations of a bellows. These swellings 710 are then cut, for example by laser cutting, to obtain from each swelling a lower flank. Connecting tongues 720, connecting the remaining concave portions 710, are retained, as are two lower fastening arms 730. A final repeat of the laser cutting operation enables the optical profile of the lower skirt to be adjusted. A mask made in this way is particularly strong because it is in one piece.

What is claimed is:

1. A motor vehicle headlight comprising:

a light source;

a reflector behind the light source; and a plurality of annular rings forming an occulting mask carried by the reflector, the annular rings defining an axis parallel to an optical axis of the headlight, the annular rings defining a plurality of passages extending in a direction away from the light source.

2. A headlight according to claim 1, wherein at least some of the passages are defined by a first face of a one of the annular rings and a second face of another of the annular rings, and the annular rings are disposed and configured to reflect light rays from the light source at least twice on the first and second faces.

3. A headlight according to claim 1, wherein the annular rings are a plurality of thin elements, each of the thin elements having two opposed sides defining a face of an associated one of the passages.

4. A headlight according to claim 3, wherein the passages are in planes parallel to each other.

5. A headlight according to claim 1, wherein the annular rings are at right angles to the optical axis.

6. A headlight according to claim 1, wherein each one of the annular rings defines a surface facing towards the light source and becoming closer to the optical axis as each of the annular rings is traversed from the rear towards the front of the mask.

7. A headlight according to claim 1, wherein the annular rings comprise a plurality of lamellae, each of the lamella having a concave face facing towards the light source.

8. A headlight according to claim 1, wherein the annular rings lie in a plane parallel to the optical axis.

9. A headlight according to claim 1, wherein the annular rings have a plurality of adjacent edges forming an optical barrier.

10. A headlight according to claim 9, wherein the adjacent edges are edges closest to the light source.

11. A headlight according to claim 9, wherein the adjacent edges are edges furthest away from the light source.

12. A headlight according to claim 9, wherein the adjacent edges are anterior edges of the annular rings.

13. A headlight according to claim 1, wherein the mask further comprises a base wall, the annular rings having a root portion joined to the base wall.

14. A headlight according to claim 1, wherein the mask has an internal wall which, when the light source is extinguished, is reflective to light within a selected color range only.

15. A headlight according to claim 1, wherein the light source comprises a lamp having a lamp base defining a rear face of the lamp, and wherein the mask further comprises (1) at least two fastening branches extending from the mask through the reflector, (2) a support carried at an end of each of the fastening branches, and (3) a wire spring cooperating with the support elements, the wire spring adapted to engage on the rear face of the lamp base to retain the lamp in position.

16. A headlight according to claim 1, wherein the mask further comprises a first mask member and a second mask member fastened to the first mask member, and wherein the first mask member has an external diameter smaller than a diameter of a circular reflector base opening defined by the reflector, and the second mask member having a diameter greater than the diameter of the reflector base opening.

17. A headlight according to claim 1, wherein the mask comprises at least two mask members and a spring disposed between the two mask members to bias the mask members away from each other, each one of the mask members having a separate element for cooperation with the corresponding element of the other mask member, so as to hold the mask members fixed together while compressing the spring between them.

18. A headlight according to claim 17, wherein the spring is annular and defines a plane, the spring further having a plurality of corrugations transverse to the plane.

19. A headlight according to claim 1, wherein the mask is made by a process consisting of a hydroforming step followed by a cutting step.

20. A headlight according to claim 1, wherein the mask comprises a support structure and the annular rings are stacked on the support structure.

21. A device comprising:

a light source;

a reflector disposed behind the light source;

a base extending from the reflector and defining a circular base opening;

a rear part having an external diameter smaller than a diameter of the reflector base opening, the rear part being fastened to the reflector;

a masking barrier fastened to the rear part, the masking barrier having a diameter greater than the diameter of the reflector base opening; and a plurality of mask elements carried by the masking barrier, the mask elements defining, in pairs at least one passage extending in a direction away from the light source.

22. A device comprising:

a light source;

a reflector disposed behind the light source;

a base extending from the reflector and defining a circular base opening;

a rear part fastened to the reflector;

a masking barrier fastened to the rear part having at least one projection on an internal surface;

a spring disposed between the rear part and the masking barrier and configured to exert a biasing force against the rear part and the masking barrier; and a plurality of mask elements carried by the masking barrier, the mask elements defining, in pairs at least one passage extending in a direction away from the light source, wherein the projection of the masking baffler is adapted to be received in a corresponding element of the rear part so as to hold the mask members fixed together while compressing the spring between them.

23. A device comprising:

a light source;

a reflector disposed behind the light source; and a mask fastened to the reflector, the mask comprising (1) a cylindrical skirt portion comprising a support structure, (2) a plurality of annular rings stacked on the support structure, the annular rings define apertures extending away from the light source, and (3) a cap portion stacked on the annular rings.

24. The device of claim 23, wherein the skirt portion, the annular rings and the cap portion are concentric.

25. A headlight according to claim 6, wherein the surfaces of the annular rings define an angle with respect to the optical axis between 20° and 45°.

* * * * *

UNITED STATES PATENT AND TRADEMARK OFFICE

CERTIFICATE OF CORRECTION

PATENT NO. : 6,619,828 B2 
DATED : September 16, 2003
INVENTOR(S) : Maurice Montet and Jean Luc Meyrenaud It is certified that error appears in the above-identified patent and that said Letters Patent is hereby corrected as shown below:

Column 14,
Line 12, the words “masking baffler” should be replaced with -- masking barrier --.

Signed and Sealed this

Eleventh Day of November, 2003

JAMES E. ROGAN
*Director of the United States Patent and Trademark Office*